US005190175A

United States Patent [19]

Schmidt

[11] Patent Number: 5,190,175

[45] Date of Patent: Mar. 2, 1993

[54] TAMPER EVIDENT CLOSURE

[75] Inventor: Frank J. Schmidt, Lisle, Ill.

[73] Assignee: Continental White Cap, Inc., Downers Grove, Ill.

[21] Appl. No.: 896,401

[22] Filed: Jun. 10, 1992

[51] Int. Cl.[5] ..... B65D 55/02

[52] U.S. Cl. ..... 215/230; 215/203; 215/318; 116/207; 252/299.7

[58] Field of Search ..... 215/203, 230, 318; 206/247; 116/206, 207, 216, 217, 219; 252/299.5, 299.7; 374/160, 162

[56] References Cited

U.S. PATENT DOCUMENTS

| | | | |
|---|---|---|---|
| 3,409,404 | 11/1968 | Fergason | 252/299.7 X |
| 3,529,156 | 9/1970 | Fergason et al. | 252/299.7 X |
| 3,576,761 | 4/1971 | Davis | 252/299.7 X |
| 3,736,899 | 6/1973 | Manske | 215/230 X |
| 4,426,881 | 1/1984 | Magoulick . | |
| 4,469,452 | 9/1984 | Sharpless et al. | 116/207 X |
| 4,480,760 | 11/1984 | Schonberger | 215/230 |
| 4,502,605 | 3/1985 | Wloszczyna | 215/230 |
| 4,505,399 | 3/1985 | Weiner | 215/230 |
| 4,519,515 | 5/1985 | Schonberger | 215/230 |
| 4,736,857 | 4/1988 | Monico, Jr. et al. | 215/230 |
| 4,793,500 | 12/1988 | Harding | 215/230 |
| 4,801,929 | 1/1989 | Instance . | |
| 4,813,712 | 3/1989 | Scopes | 283/114 |
| 4,877,143 | 10/1989 | Travisano | 215/230 |
| 5,018,632 | 5/1991 | Schmidt | 215/230 |
| 5,022,545 | 6/1991 | Carson | 215/230 |
| 5,104,704 | 4/1992 | Labes et al. | 215/230 X |

FOREIGN PATENT DOCUMENTS

| | | | |
|---|---|---|---|
| 9200891 | 1/1992 | World Int. Prop. O. | 215/230 |

*Primary Examiner*—Allan N. Shoap
*Assistant Examiner*—Stephen Cronin
*Attorney, Agent, or Firm*—Lockwood, Alex, FitzGibbon & Cummings

[57] ABSTRACT

In accordance with the present invention, an irreversible tamper evident system for a closure such as a button closure is provided. The irreversible tamper evidence system is provided by an appearance change system carried by the flexible button portion of the closure. The appearance change system comprises a liquid crystal material and a liquid crystal poison. When the button is depressed such as upon initial closure of the container, the liquid crystal material is separated from the liquid crystal poison and optical properties of the liquid crystal material are viewable. When the container is opened the flexing the button forces the liquid crystal poison into contact with the liquid crystal material and the optical properties of the liquid crystal material are irreversibly altered.

11 Claims, 1 Drawing Sheet

TAMPER EVIDENT CLOSURE

The present invention generally relates to new and useful improvements in closures having end panels of which at least an area is formed to flex when the closure is applied to a container and, more particularly, to a closure wherein the flexible area of the end panel is provided with an irreversible tamper indicating system which is actuated when the flexible area of the end panel flexes from a sealed condition to an unsealed condition.

BACKGROUND OF THE INVENTION

Among the various closures made for the food and beverage industry is a "button" or "pop top" closure wherein the closure contains a flexible portion which assumes a given flexed position to indicate a sealed package and a different position when the package seal is breached. These "button" or "pop top" closures are commonly used in vacuum sealed food products such as baby food products to warn purchasers when the vacuum condition under which the food was packaged has been breached.

Although closures having tamper indicating buttons are predominantly in use in vacuum applications, there also have been more recently developed closures with buttons which are mechanically actuated so as to move from an as formed "down" position to an upwardly projecting "up" position when the closure is properly applied to a container. In this "up" position the closures are further characterized as having energy stored within the closure end panels urging the buttons to their as formed "down" position. Removal of these closures from the containers associated therewith results in the buttons moving to their as formed "down" position due to the release of the energy stored within the end panels.

Closures having end panels incorporating tamper indicating buttons are used extensively for the food industry, especially for vacuum packaged product, because they are effective quick-detection means that lets one know some very important conditions about the container. Typically in vacuum applications, when the container is properly sealed and a vacuum exists therein, the button is in a "down" position while when the container has been opened and the closure reapplied, or the vacuum within the container otherwise lost, the button will be in its "up" position. Additionally, in vacuum package applications, when the closure is first opened and the vacuum is lost, a hissing sound may be heard.

Through the extensive commercial use of such button closures, the purchasing public has become generally aware that if the deflectable section of the button is up then the original seal has been broken and that the container should be rejected. Additionally, in the case where the button closure is used in conjunction with a vacuum package container, the purchasing public has been sensitized to listen for a hiss of air or a "popping" sound to determine whether or not that container has been previously opened.

The popping of the top and, in the case of a vacuum packaged product, the sound associated with the loss of vacuum are indicating means to warn purchasers when the integrity of the package has been breached. These indicators, however, are not fool proof and can be intentionally overridden. For example, it is known that a button closure for a vacuum packaged product can be returned to its "tamper free" state even after the package has been opened. This is accomplished by merely heating the open container and when the container is hot, recapping the closure. This procedure will recreate the vacuum seal and reset the button.

Separate tamper evident means have been used in association with button caps to augment the flip or pop of the button. For example, button caps, and other screw top closures, are often used in association with a shrink wrap. Also, the button cap may be provided with a band at its base, joined to the remainder of the cap through a line of weakness. The band is prevented from rotating or from rising up the screw thread when the cap is unscrewed, and as a result, upon closure opening, the band becomes detached from the remainder of the cap.

The packaging industry has also recognized the desirability of providing a visual means to determine whether the integrity of a sealed container has been breached. For example, U.S. Pat. No. 3,736,899 (Manske) is directed to a pressure change indicator. The '899 patent discloses a button type cap having a flexible panel with a reflective surface and a disk-like element which covers up all or most of the flexible panel when the panel is flexed inward but which provides a gap around the periphery of the panel when it is flexed outward. The gap reveals a highly visible or contrasting color which is seen on the flexible panel either by means of a color on the panel itself or a color on the underside of the disk-like member. The pressure change system of the '899 patent apparently may be reestablished by recreating the vacuum in the package and, accordingly, in such a case would not be irreversible.

U.S. Pat. No. 4,813,712 (Scopes) is directed to providing a visible indication of whether a button cap is in its concave or convex form. According to the '712 patent the condition of the button can be determined by applying a pattern to the button surface which pattern can display one visible form when the surface is concave and a different visible form when the surface is convex. The different visible forms can include two different colors. In this regard, the '712 patent discloses a button cap having an embossed pattern wherein the pattern displays one color when in a given orientation such as concave and displays a different color when the orientation changes such as to convex. In another embodiment, the pattern is formed of superimposed layers which are displaced relative to one another when the surface changes between its concave and convex forms. Either the layers or the substrate for the layers contains a grid pattern which provides the closure with different appearances in the concave and convex forms. As noted in the '712 patent, a high degree of accuracy is required in laying down the patterns to ensure the colors register correctly with the embossed pattern to produce the desired visual result. Additionally, the surface indicating systems of the '712 patent appear to be reversible.

U.S. Pat. No. 4,877,143 (Travisano) is directed to a closure such as a button cap wherein the button carries an indicator such as a color or an imprinted work like "open" thereon. The indicator is covered with a translucent layer having a light diffusing surface which is provided by a Fresno lens. When the button is in the sealed position, the indicator is drawn away from the translucent/light diffusing layer which results in the indicator being obscured so that it cannot be seen through the translucent layer. When the container is opened and the button flips, the indicator is brought into contact with the translucent layer and the indicator becomes visible therethrough. Similar to the '712 (Scopes) patent above, the tamper evident system of the '143 patent appears to be a reversible system rather than an irreversible system.

Despite recognition of the need for tamper proof or tamper evident button closures, and responsive efforts related thereto there still exists the need for an improved tamper evident button closure.

SUMMARY OF THE INVENTION

The present invention provides an irreversible tamper indicating system for use in conjunction with closures having deflectable end panel areas such as button closures. The irreversible tamper indicating system of the present invention comprises a system which undergoes an irreversible change in appearance upon deflection of the end panel area such as the flipping of the button of a button cap. The irreversible tamper indicating system comprises a liquid crystal material which can display distinct optical properties and which can undergo an irreversible change in optical properties when the liquid crystal properties of the system are destroyed.

In accordance with the preferred embodiment of the present invention, the liquid crystal material is applied on the surface of a rigid transparent plastic plane. The plastic plane is secured to the top of a button closure in overlying, covering relationship to the button with the liquid crystal material facing the button. The surface of the button carries a poison for the liquid crystal material.

In practice, such as in a vacuum sealed container, in the sealed state the button is drawn away from the transparent plastic cover and the liquid crystal material is separated from the liquid crystal poison by an air gap. The optical properties of the liquid crystal material are viewable through the transparent cover. Upon release of the vacuum within the container, either by opening the container or by other cause of vacuum loss, the button flexes and forces the poison into contact with the liquid crystal material and causes a consequent irreversible change in optical properties of the liquid crystal material.

In accordance with the irreversible aspect of the present invention, the liquid crystal material and the poison must be selected so that once the optical properties of the liquid crystal are altered by contact between the liquid crystal material and the poison, those optical properties cannot be reestablished. Accordingly, preferably the poison comprises a dark colored absorbent material which when separated from the liquid crystal material permits observation of the optical characteristics of the liquid crystal material and which when placed in contact with the liquid crystal material irreversibly disrupts the optical properties of the liquid crystal material.

The use of a liquid crystal indicating materials in other applications is disclosed in patents such as U.S. Pat. No. 4,426,881 which is directed to a pressure gauge utilizing cholesteric liquid crystals whose optical character can be altered as a function of pressure as a pressure indicator. U.S. Pat. No. 4,736,857 is directed to a fairly complicated tamper indicating closure wherein an irreversible and nonrepeatable sequence of messages is displayed via a liquid crystal display (LCDM) upon removal of the closure from the container. In one embodiment, the '857 patent does disclose the use of a pressure transducer (see column 12, line 56, column 13, line 32) to activate the LCD. U.S. Pat. No. 4,801,929 is directed to a container which emits an audible signal or message when the container is opened. In addition to the audible signal, the cap of the container can also have a liquid crystal display which can display a particular message when the container is opened. The audible signal and LCD are activated by a triggering device which may, for example, be a pressure transducer which detects the pressure applied by a person's fingers to a cap.

U.S. Pat. No. 4,469,452 is directed to using a cholesteric liquid crystal system which can undergo an irreversible color change in optical properties as a temperature indicator. The liquid crystal material is irreversibly altered either by physical or chemical interaction with an activator. As the purpose of the '452 patent is to indicate achievement of a given temperature, the activators have an activation temperature substantially coinciding with the predetermined temperature. According to the '452 patent, a preferred embodiment also includes the use of a dark background such as red, blue, green or brown which will become observable when the system activates and the liquid crystal material becomes colorless.

Accordingly, it is the general object of the present invention to provide an improved tamper evident closure.

It is another object of the present invention to provide an improved tamper evident button closure.

It is another object of the present invention to provide an improved tamper indicating system in the form of an optical change system.

It is another object of the present invention to provide an irreversible tamper evident optical change system for closure which contains a flexible portion which assumes a given position to indicate a sealed package and a different position when the package seal is breached where in the sealed position the distinct optical properties of a liquid crystal indicator are viewable and in the breach condition the distinct optical properties have been irreversibly altered.

These and other objects of the invention will invention with references to the accompanying drawings.

DETAILED DESCRIPTION OF THE PREFERRED EMBODIMENTS OF THE INVENTION

Figure 1:
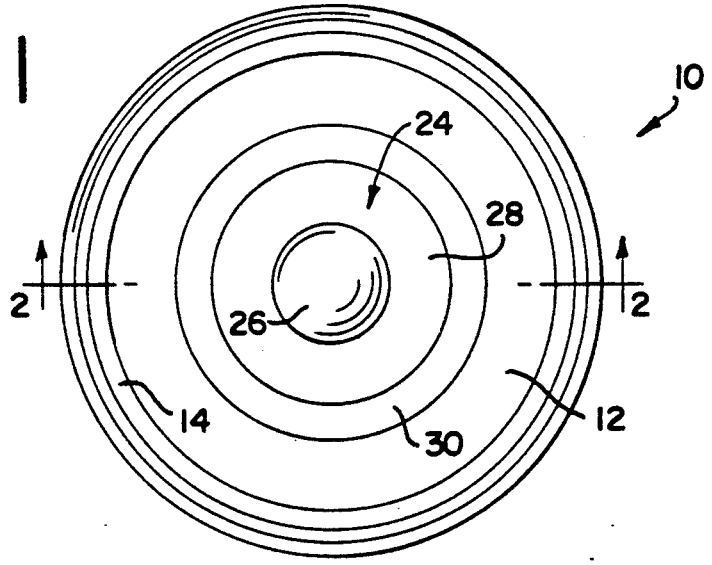
FIG. 1 is a top plan view of a conventional prior art tamper evident closure incorporating a conventional safety button.
Figure 2:
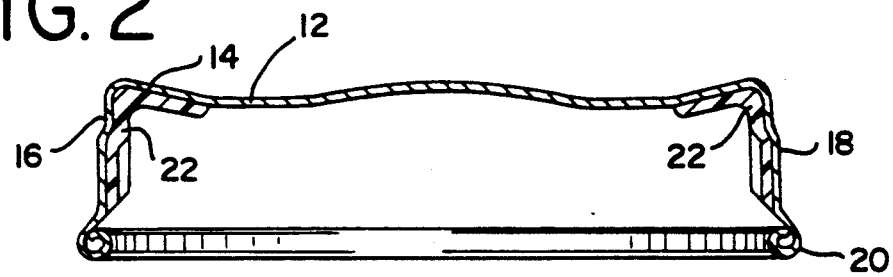
FIG. 2 is a transverse vertical sectional view taken generally along the line 2—2 of FIG. 1 and shows the cross-section of the closure with the button in its "up" convex state.

Referring now to the drawings in detail, reference is first made to FIGS. 1 and 2 which illustrate a typical metallic button closure. The closure is generally identified by the numeral 10 and includes an end panel 12 which has an upwardly and outwardly sloping peripheral portion 14 defining the downwardly opening channel 16. The end panel 12 terminates in a generally cylindrical skirt 18 which, in turn, terminates in an inwardly turned curl 20.

In order that the closure 10 may be applied to a container (not shown) of the type including a neck finish having external threads, the skirt 18 and the channel 16 are lined with a suitable sealing compound 22. When the closure 10 is pressed down on a neck finish of a container, a seal between the closure 10 and the container is formed between that portion of the sealing compound 22 underlying the end panel 12 while an interlock is formed between the threads of the container by that portion of the sealing compound 22 which lines the skirt 18.

The closure 10 is constructed in a manner wherein the end panel 12 is provided with a centrally located button generally indicated by the number 24. The button 24 includes a central post portion 26 surrounded by an upwardly sloping annular portion 28 which, in turn, is surrounded by an annular generally flat portion 30. Preferably, the button 24 is mechanically reformed after its initial formation to a state of compressive residual stress such as by mechanically reforming in the manner described in U.S. Pat. No. 5,016,769 which is incorporated by reference herein.

Figure 3:
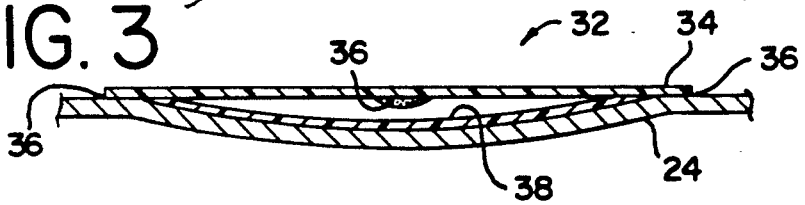
FIG. 3 is a sectional view showing the crosssection of the closure after the closure has been applied to a container and the button deformed by a vacuum within the container and showing more specifically the details of the tamper evident system of the present invention which includes a liquid crystal indicator material and a liquid crystal poison separated from each other when the closure is in its sealed state.

Referring now to FIG. 3, in particular, it will be seen that when a closure 10 is applied to a container and a vacuum is drawn within such container, the button 24 is drawn downwardly. In accordance with the preferred embodiment of the invention, by mechanically reforming the button 24 as the closure 10 is being formed, the button 24 has certain stored stresses which facilitate its being maintained in the "up" normally convexed position of FIGS. 1–2 and 4. When the button 24 is drawn down into the container as shown in FIG. 3, these compressive stresses increase and there is a high tendency for the button 24 to flip upwardly from its "down" concave position of FIG. 3 back to its original "up" convex position. Thus, when the closure 10 is removed from a container and the vacuum applied against the underside of the end panel 12 is released, the button 24 will flip, snap or pop upwardly to its original position. It is this flipping action of the button 24 that actuates the tamper evident system of the present invention.

The present invention particular relates to a button enhancement appearance change system which, as shown in FIG. 3, is generally identified by the numeral 32 and which is applied to the button 24. The button appearance change system 32 is particularly constructed to specifically designate that the closure 10 has been removed from the container even if the closure 10 is again placed on the container in the sealed closed position and thus forms tamper evident means for the closure 10.

The appearance change system 32 includes a window member 34 which covers the button area 24 and is secured along its periphery 36 to closure 10. Preferably window member 34 is a rigid transparent plastic circular plane which is mounted in overlying relationship to the button 24. As will be appreciated from the present disclosure, other materials can be used for window member 34 including transparent tape such clear polypropylene or polyester films which can be bonded to closure 10 such as by adhesively fixing or heat sealing the film to closure 10. In choosing appropriate materials for window member 10, in general, three criteria should be kept in mind: first the material should not interfere with the viewability of appearance change system 32; second, the material, when mounted, should have sufficient rigidity and strength necessary for the other aspects appearance change system 32 more fully described herein; and third, the material should be susceptible to carrying a liquid crystal indicator material 36 or a liquid crystal poison material 38 on its interior surface.

The appearance change system 32 also includes a liquid crystal material 36, which displays distinct optical properties over the desired temperature ranges contemplated for closure 10. The liquid crystal material includes, but is not limited to, iridescent liquid crystals and liquid crystals in which an electrical or field effect can change the opacity or orientation of the liquid crystals.

Cholesteric liquid crystals such as those described in U.S. Pat. No. 3,576,761 to Davis et al., issued Apr. 27, 1971, which is expressly incorporated by reference herein, are exemplary of liquid crystals broadly useful in the practice of this invention. These, and other liquid crystals are described in U.S. Pat. No. 4,469,452 Sharpless et al., issued Sep. 4, 1984, which description is also incorporated by reference herein. As discussed therein, exemplary cholesteric liquid crystal systems are those which exhibit color over a broad range of temperatures. These liquid crystal systems can be chemically or physically altered with a resultant change in optical properties such as changing from exhibiting a color to becoming colorless.

The appearance change system 32 also includes a liquid crystal poison material 38 which can either chemically or physically interact with the liquid crystal material 36 to cause an irreversible change in the appearance of the liquid crystal material 36. The liquid crystal poison material 38 can be a chemical which is intersoluble with the liquid crystal indicator material 36 and which can cause the liquid crystal material to irreversibly change in it optical properties such by causing the liquid crystal system to undergo a phase transition. The liquid crystal poison material 38 can also take the form of an absorbent material, such as a cotton pad or the like, which will irreversibly disrupt or mask the optical properties of the liquid crystal material 36 when placed in contact with the liquid crystal material 36.

As best illustrated in FIG. 3, preferably, the liquid crystal poison material 38 is secured to the button 24. Preferably, the liquid crystal poison material 38 is an absorbent material such as a cotton pad which is adhesively mounted on button 24. The liquid crystal material 36 is secured to the button side of window 34 such as by adhesively mounting the liquid crystal material 36 on the window 34. Preferably, the window member 34 carrying the liquid crystal material 36 is mounted over the button carrying the liquid crystal poison 38 after the button has been deformed to its concave "down" position such as occurs after the closure 10 has been applied to a container and a vacuum has been drawn within the container.

Figure 4:
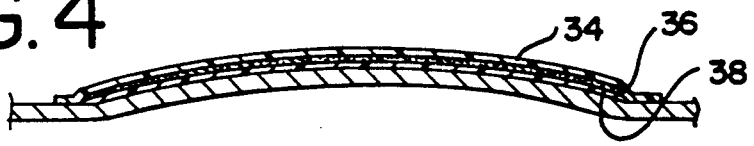
FIG. 4 is a sectional view through the button after the closure has been removed from the associated container and the button has been flexed to its "up" position causing the liquid crystal poison to contact the liquid crystal material.

As noted above, when the button 24 is in its down position of FIG. 3, it has stored energy and is in a state of stress such that when the vacuum is removed by removal of the closure 10 from the container, the button 24 will flex upwardly to its original position as shown in FIG. 4. As shown in FIG. 4, when the button 24 flexes upwardly, the liquid crystal poison 38 is forced against the liquid crystal material 36 causing an irreversible alteration in the appearance of the liquid crystal material such as in the case of an iridescent liquid crystal material causing the material to loose its iridescence irreversibly. It will thus be appreciated that window member 34 has been sufficiently secured to the button 24 and has sufficient strength and rigidity to withstand the upward flexing of the button 24 and to allow the poison 38 to irreversibly disrupt the appearance of liquid crystal material 36.

Preferably, the liquid crystal poison material 38 is a dark colored absorbent material such as a black, blue, red or green colored cotton pad and the liquid crystal material 36 preferably has iridescent optical properties and selectively scatters impingent white light while transmitting part of the impingent light. In this arrangement, the dark colored background enhances the observation of the optical properties of the liquid crystal material prior to its being poisoned, and upon the loss of optical properties by the liquid crystal material 36, the background color will become observable.

The liquid crystal poison material 38 can, of course, take on a number of different forms. For example, a pod or similar device containing one or more chemical substances susceptible to undergoing an exothermic reaction can be attached to the button 24 on the outside surface of the cap. A temperature sensitive encapsulated liquid crystal material 36 can be attached to the outside surface of the pod. Such that upon opening the container the pod will internally rupture and allow its contents to mix. The mixing of the substances in the pod will cause an exothermic reaction to proceed which raises the temperature of the liquid crystals above their given operating range causing a color change or a message to appear in the liquid crystal material 36. Alternatively, an electrochemical cell can be attached to the button 24 on the outside surface of the cap. On the outside surface of the electrochemical cell a liquid crystal device can be placed in a manner such that when the container is opened, the electrochemical cell is activated and produces a change in the liquid crystal layer such as by one of the following mechanisms: (1) the cell current is discharged through a resistive element which produces an increase in temperature which causes the temperature sensitive liquid crystal material 36 to undergo a color change or to cause a message to appear in the liquid crystal material 36; or (2) the cell current is change the opacity or orientation of the liquid crystal material 36 producing a message to appear.

Figure 5:
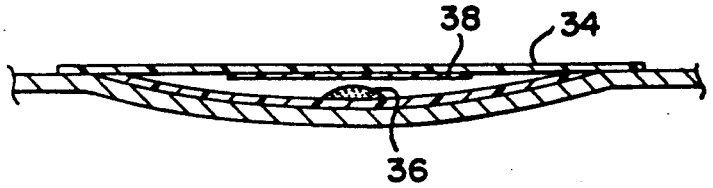
FIG. 5 is a sectional view similar to that of FIG. 3 which shows further details of an embodiment of the tamper evidence system provided on the button including a liquid crystal material carried by the button and a liquid crystal poison carried by a transparent cover overlying the button.

FIG. 5 illustrates an alternate embodiment of the present invention wherein the liquid crystal material 36 is secured to the external surface of the button 24 and the liquid crystal poison 38 is secured to the internal surface of window member 34. In this embodiment, it will be appreciated that to avoid interfering with the viewability of appearance change system 32, it will be necessary to select a liquid crystal poison material 38 which does not obscure the optical properties of liquid crystal material 38 prior to activation of appearance change system 32.

What is claimed is:

1. A tamper evident closure comprising a closure including a flexible end panel portion having formed therein a sealing state indicating area which can flex from a seal indicating position to a non-seal indicating position, a cover in overlying relationship to said sealing state indicating area, a liquid crystal indicator housed between the external surface of said sealing state indicating area and the interior surface of said cover, said liquid crystal indicator having distinct optical properties viewable through said cover when said flexible end panel is in a seal indicating position, means for irreversibly disrupting said liquid crystal indicator, said means positioned to irreversible disrupt said liquid crystal indicator when said flexible end panel flexes to its non-seal indicating position whereby when said flexible end panel flexes to its non-seal indicating position said distinct optical properties irreversibly change.

2. The closure of claim 1 wherein said liquid crystal indicator comprises an iridescent liquid crystal material.

3. The closure of claim 1 wherein said cover comprises a rigid transparent plastic material.

4. The closure of claim 3 wherein said liquid crystal indicator is carried by the internal surface of said cover.

5. The closure of claim 1 wherein said means comprises a liquid crystal poison material.

6. The closure of claim 5 wherein said poison comprises an absorbent material.

7. The closure of claim 6 wherein said absorbent material is dark colored and is secured to the external surface of said sealing state indicating area.

8. A tamper evident closure comprising a closure including a flexible end panel portion having formed therein a sealing state indicating area which can flex from a seal indicating position to a non-seal indicating position due to the release of energy stored within said end panel, said sealing state indicating area carrying a liquid crystal poison, a rigid transparent window secured to said closure in overlying relationship to said sealing state indicating area, said window carrying a liquid crystal indicator having distinct optical properties on its interior surface, said liquid crystal indicator being separate from said poison and viewable through said window when said end panel is in a seal indicating position, said poison and said liquid crystal indicator being positioned so that when said flexible end panel flexes to its non-seal indicating position said poison interacts with said liquid crystal indicator to cause an irreversible change in the optical properties of said liquid crystal indicator.

9. The closure of claim 8 wherein said poison is an absorbent material.

10. The closure of claim 8 wherein said poison is a chemical which is intersoluble with said liquid crystal indicator.

11. The closure of claim 8 wherein said window is plastic.

* * * * *